US006069453A

United States Patent [19]

Arts et al.

[11] Patent Number: 6,069,453

[45] Date of Patent: May 30, 2000

[54] BALLAST CIRCUIT FOR REDUCING STRIATIONS IN A DISCHARGE LAMP

[75] Inventors: Paulus P. B. Arts; Marcel Beij; Arnold W. Buij, all of Eindhoven, Netherlands

[73] Assignee: U.S. Philips Corporation, New York, N.Y.

[21] Appl. No.: 08/715,689

[22] Filed: Sep. 18, 1996

[30] Foreign Application Priority Data

Sep. 25, 1995 [EP] European Pat. Off. ..... 95202578

[51] Int. Cl.[7] ..... H05B 27/02

[52] U.S. Cl. ..... 315/209 R; 315/DIG. 7; 315/247; 315/224; 315/219

[58] Field of Search ..... 315/DIG. 7, 219, 315/247, 307, 221, 224; 4/4

[56] References Cited

U.S. PATENT DOCUMENTS

| | | | |
|---|---|---|---|
| 4,682,082 | 7/1987 | Mac Askill et al. | 315/219 |
| 5,189,343 | 2/1993 | Pacholok | 315/219 |
| 5,369,339 | 11/1994 | Rejjnaerts | 315/DIG. 7 |
| 5,382,881 | 1/1995 | Farkas | 315/DIG. 7 |
| 5,471,117 | 11/1995 | Ranganath et al. | 315/247 |

FOREIGN PATENT DOCUMENTS 2119184 11/1983 United Kingdom .

*Primary Examiner*—Michael B. Shingleton
*Attorney, Agent, or Firm*—Bernard Franzblau

[57] ABSTRACT

A circuit for operating a discharge lamp from input terminals of a low frequency (f) supply voltage source with a rectifier coupled to the input terminals for rectifying the low-frequency supply voltage. A capacitor is coupled to the output of the rectifier. A DC-AC converter is coupled to the capacitor for generating a lamp current which comprises a DC component and a high-frequency AC component, the amplitude of the high-frequency AC component being modulated with a low frequency which is equal to twice the frequency f. An apparatus (V) adjusts the lamp power. The circuit parameters are chosen such that during operation the average amplitude of the high-frequency lamp current component is at least 500 times the amplitude of the low-frequency modulation of the high-frequency lamp current component with the power set for its maximum adjustable value. As a result, the discharge lamp can be dimmed over a wide range without striations occurring.

21 Claims, 1 Drawing Sheet

BALLAST CIRCUIT FOR REDUCING STRIATIONS IN A DISCHARGE LAMP

BACKGROUND OF THE INVENTION

The invention relates to a circuit arrangement for operating a discharge lamp, provided with input terminals for connection to a supply voltage source, rectifying means coupled to the input terminals for rectifying a low-frequency supply voltage with a frequency f delivered by the supply voltage source, capacitive means coupled to outputs of the rectifying means, a DC-AC converter coupled to the capacitive means for generating a lamp current which comprises a DC component and a high-frequency AC component, the amplitude of the high-frequency AC component being modulated with a low frequency which is equal to twice the frequency f, and means V for adjusting the power consumed by the discharge lamp.

Such a circuit arrangement is known from British Patent GB 2,119,184. The known circuit arrangement is designed more in particular for operating a low-pressure mercury discharge lamp. The means V render it possible to adjust the luminous flux of the discharge lamp through adjustment of the power consumed by the discharge lamp. The DC component of the lamp current contributes to the suppression of striations. It was found, however, that striations can occur, also in dependence on the composition of the plasma of the discharge lamp, especially when the power consumed by the discharge lamp is set for a comparatively low value. Since said DC component forms part of the lamp current, it is possible to set the luminous flux of the discharge lamp for a lower value than would be possible if the lamp current were to comprise exclusively a high-frequency AC component. If it is desired to set the discharge lamp luminous flux for a very low value, however, it was found to be not impossible without further measures to suppress the striations by the mere exclusive addition of a DC component is added to the high-frequency AC component of the lamp current.

SUMMARY OF THE INVENTION

The invention has for an object to provide a circuit arrangement which makes it possible to suppress striations in a discharge lamp operated by means of the circuit arrangement even if the luminous flux of the discharge lamp, and accordingly also the power consumed by the discharge lamp, are set for very low values According to the invention, a circuit arrangement as mentioned in the opening paragraph is for this purpose characterized in that the dimensioning of the circuit arrangement is chosen such that the average amplitude of the high-frequency lamp current component is at least 500 times the amplitude of the low-frequency modulation of the high-frequency lamp current component during lamp operation with the power set for a maximum adjustable value.

During lamp operation a voltage is present across the capacitive means which is the sum of a first DC component of substantially constant amplitude and a second, low-frequency DC component having a frequency equal to twice the frequency f. As a result of this second low-frequency DC component, a modulation of the amplitude of the high-frequency AC component of the lamp current occurs with a modulation frequency equal to twice the frequency f. It is found in practice that the ratio between the average amplitude of the high-frequency lamp current component and the amplitude of the low-frequency modulation decreases in proportion as the power consumed by the discharge lamp decreases. A reduction of the amplitude of the second low-frequency DC component of the voltage across the capacitive means, which also implies a reduction of the amplitude of the low-frequency modulation of the high-frequency current component, is found to suppress striations. It was found more in particular that striations in a discharge lamp operated by means of the circuit arrangement according to the invention are not or are hardly visible, even if the luminous flux of the discharge lamp, and accordingly the power consumed by the discharge lamp, are set for very low values.

It should be noted that U.S. Pat. No. 4,682,082 discloses a circuit arrangement for operating a discharge lamp provided, as is the circuit arrangement mentioned in the opening paragraph, with input terminals, rectifying means, capacitive means, a DC-AC converter, and means V for adjusting the power consumed by the discharge lamp. The voltage present across the capacitive means during lamp operation is, as in a circuit arrangement as mentioned in the opening paragraph, the sum of a first DC component of substantially constant amplitude and a second, low-frequency DC component with a frequency equal to twice the frequency of the supply voltage. The lamp current generated by the DC-AC converter forming part of this circuit arrangement comprises no DC component but exclusively a low-frequency modulated high-frequency AC component. It was found for this circuit arrangement that the suppression of striations in a discharge lamp operated by means of this circuit arrangement can be realised through an increase in the amplitude of the modulation of the high-frequency AC component. This increase in the amplitude of the modulation of the high-frequency AC component was realised in this circuit arrangement by means of an increase in the amplitude of the second low-frequency DC component of the voltage across the capacitive means. It is suprisingly found, therefore, that the low-frequency modulation of the high-frequency lamp current component has a negative effect or a positive effect on the occurrence of striations, depending on the presence of a DC component in the lamp current.

A dimensioning whereby the average amplitude of the high-frequency lamp current component is at least 500 times the amplitude of the low-frequency modulation of the high-frequency lamp current component during lamp operation with the power set for its maximum adjustable value, referred to hereinafter as desired dimensioning, can be realised in various ways. If, for example, the dimensionings of the other components of the circuit arrangement are left unchanged, the amplitude of the low-frequency modulation of the high-frequency AC component of the lamp current decreases in proportion as the capacitance of the capacitive means is increased. It is possible accordingly to realise the desired dimensioning by choosing the capacitance of the capacitive means to be comparatively high.

In many cases, the circuit arrangement is provided with a load branch comprising a series circuit of terminals for accommodating the discharge lamp and a capacitive element, the capacitive element being shunted by an ohmic resistor. The ohmic resistor in such a circuit arrangement forms a means for generating the DC component of the lamp current. If the dimensioning of the other components is left unchanged, a reduction in the capacitance of the capacitive element also leads to an increase in the ratio between the average amplitude of the high-frequency AC component and the amplitude of the low-frequency modulation of the high-frequency current component. The desired dimensioning may thus be realised in such a circuit arrangement in that the capacitance of the capacitive element is chosen to be comparatively low. A disadvantage of this manner of realising the desired dimensioning is that a reduction in the capacitance of the capacitive element also causes the total impedance of the load branch to increase. It was found to be possible in practice in many cases, however, to realise the desired dimensioning without the impedance of the load branch reaching an undesirably high value when the capacitance of the capacitive means is chosen such that the amplitude of the first DC component is at least 20 times the amplitude of the second, low-frequency DC component with the power set for its maximum adjustable value.

In many cases, again, the circuit arrangement comprises a DC-DC converter coupled between the outputs of the rectifying means and the capacitive means and provided with a switching element, a unidirectional element, an inductive element, and control means coupled to the capacitive means and to the switching element. The control means generate a control signal which renders the switching element conducting and non-conducting. The frequency and the duty cycle of this control signal define the current with which the capacitive means are charged from the voltage source. The control means may be so constructed that the amplitude of the second low-frequency DC voltage across the capacitive means is comparatively small, for example, by means of a modulation at a frequency equal to twice the frequency f of the frequency and/or duty cycle of the control signal, whereby again the desired dimensioning can be realised.

A preferred embodiment of a circuit arrangement according to the invention is provided with asymmetry means for rendering an amplitude Al of the high-frequency AC component of the lamp current in the polarization direction of the DC component of the lamp current unequal to an amplitude A2 of the high-frequency AC component of which the polarization direction is opposed to that of the DC component. The fact that amplitude A1 and amplitude A2 are rendered unequal is found to contribute further to the suppression of striations. It was found to be possible in practice to set the luminous flux of a discharge lamp operated by the circuit arrangement for a lower value, without striations being visible, than was possible with the use of a circuit arrangement without asymmetry means. It was also found that, with amplitude A1 greater than amplitude A2, a more effective suppression of striations could be realised than with amplitude A2 greater than amplitude A1. In an advantageous modification of the preferred embodiment, the DC-AC converter is provided with

- a branch comprising a series arrangement of a first switching element and a second switching element,
- a load branch shunting one of the switching elements and provided with terminals for accommodating the discharge lamp,
- a control circuit coupled to the switching elements for rendering said switching elements alternately conducting and non-conducting at a high frequency, and wherein the asymmetry means are provided with means for rendering the period of conduction of the first switching element unequal to the period of conduction of the second switching element. The advantageous modification of this embodiment forms a reliable design for the circuit arrangement in which also the asymmetry means are realised in a comparatively simple and reliable manner.

BRIEF DESCRIPTION OF THE DRAWING

Embodiments of the circuit arrangement according to the invention will be explained with reference to the accompanying drawing, in which.

DESCRIPTION OF THE PREFERRED EMBODIMENTS

Figure 1:
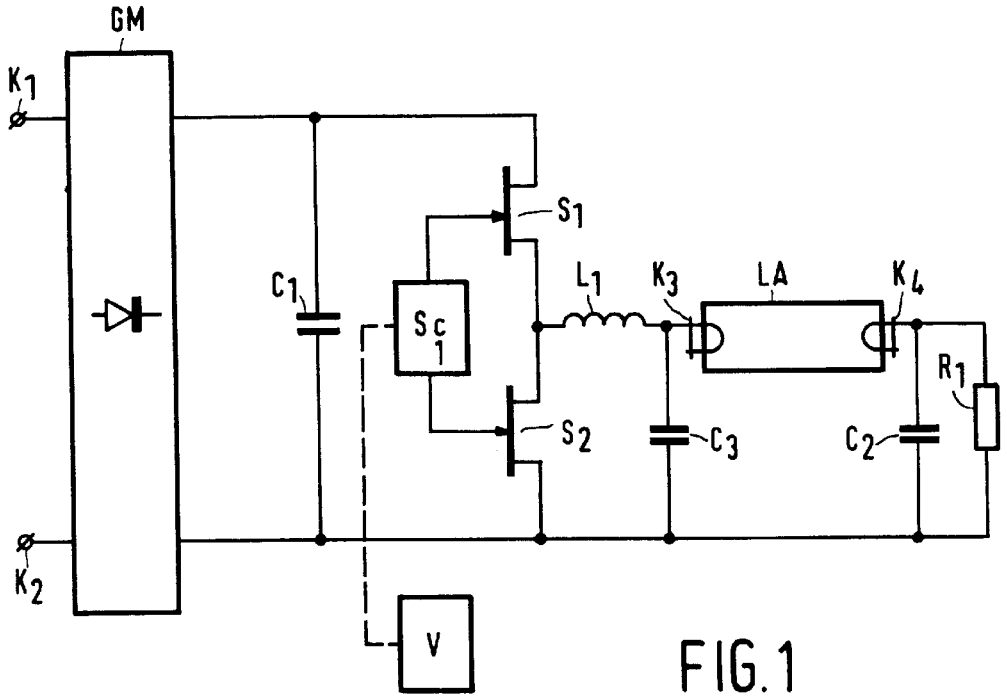
FIG. 1 is a diagramm of a first embodiment of a circuit arrangement according to the invention.

In FIG. 1, K1 and K2 are input terminals for connection to a supply voltage source. GM are rectifying means coupled to the input terminals for rectifying a low-frequency supply voltage supplied by the supply voltage source with frequency f. Capacitor C1 in this embodiment forms a capacitive means coupled to an output of the rectifying means. Circuit portions V and SC1, switching elements S1 and S2, coil L1, capacitors C2 and C3, ohmic resistor R1, and terminals K3 and K4 for holding a discharge lamp together form a DC-AC converter coupled to the capacitive means for generating a lamp current. Coil L1, terminals K3 and K4, capacitors C2 and C3, and ohmic resistor R1 together form a load branch. A discharge lamp LA is connected to terminals K3 and K4. Circuit portion SC1 forms a control circuit for rendering the switching elements S1 and S2 alternately conducting and non-conducting at a high frequency. Circuit portion V in this example forms means V for adjusting the power consumed by the discharge lamp.

Input terminals K1 and K2 are connected to respective inputs of the rectifying means GM. A first output of the rectifying means GM is connected to a second output of the rectifying means GM via capacitor C1. Capacitor C1 is shunted by a series arrangement of switching element S1 and switching element S2. A common junction point of switching element S1 and switching element S2 is connected to a first end of coil L1. A second end of coil L1 is connected to terminal K3 and a first side of capacitor C3. A further side of capacitor C3 is connected to the second output of the rectifying means GM. Terminal K3 is connected to terminal K4 via the discharge lamp LA. Capacitor C2 connects terminal K4 to the second output of the rectifying means GM. Capacitor C2 is shunted by ohmic resistor R1. A first output of circuit portion SC1 is connected to a control electrode of switching element S1. A second output of circuit portion SC1 is connected to a control electrode of switching element S2. An output of circuit portion V is coupled to an input of circuit portion SC1. This coupling is indicated with a broken line in FIG. 1.

The operation of the embodiment shown in FIG. 1 is as follows.

When input terminals K1 and K2 are connected to a supply voltage source, the low-frequency supply voltage of frequency f supplied by the supply voltage source is rectified by the rectifying means GM, and a voltage is present across capacitor C1 which is the sum of a first DC component of substantially constant amplitude and a second low-frequency DC component having a frequency equal to twice the frequency f. This voltage acts as the supply voltage for the DC-AC converter. Circuit portion SC1 renders switching element S1 and switching element S2 alternately conducting and non-conducting at a high frequency. As a result of this, a high-frequency, substantially square-wave voltage is present between the ends of the load branch. This high-frequency, substantially square-wave voltage causes a current to flow in the load branch which is the sum of the current through capacitor C3 and the lamp current. The lamp current comprises a high-frequency AC component whose frequency is equal to that of the high-frequency, substantially square-wave voltage. The lamp current also comprises a DC component owing to the presence of ohmic resistor R1. The second, low-frequency DC component of the voltage across capacitor C1 causes a low-frequency modulation of the amplitude of the high-frequency AC component of the lamp current with a frequency equal to twice the frequency f. The power consumed by the discharge lamp, and thus also the luminous flux of the discharge lamp, can be adjusted by means of circuit portion V. This adjustment takes place by means of an adjustment of the frequency and/or duty cycle of the control signal generated by circuit portion SC1. The embodiment shown in FIG. 1 is dimensioned such that the average amplitude of the high-frequency AC component is at least 500 times the amplitude of the low-frequency modulation of the high-frequency lamp current component with the power set for its maximum adjustable value. It is achieved thereby that the power consumed by the discharge lamp can be adjusted over a very wide range without striations being visible in the discharge lamp. If, for example, the dimensionings of the other components of the circuit arrangement are left unchanged, the amplitude of the low-frequency modulation of the high-frequency AC component of the lamp current decreases in proportion as the capacitance of capacitor C1 is increased. It is thus possible to realise the desired dimensioning in that the capacitance value of the capacitor C1 is chosen to be comparatively high. The load branch further comprises capacitor C2 in series with terminals K3 and K4 for holding the discharge lamp, which capacitor C2 is shunted by ohmic resistor R1. With the dimensionings of the other components left unchanged, a reduction in the capacitance of capacitor C2 now leads to an increase in the ratio between the average amplitude value of the high-frequency AC component and the amplitude of the low-frequency modulation of the high-frequency current component. In the embodiment shown in FIG. 1, therefore, the desired dimensioning may also be realised in that the capacitance of capacitor C2 is chosen to be comparatively low. To increase the range of the power consumed by the discharge lamp further, circuit portion SC1 is also provided with asymmetry means (not shown in FIG. 1) for rendering an amplitude A1 of the high-frequency AC component of the lamp current in the polarization direction of the DC component of the lamp current unequal to an amplitude A2 of the high-frequency AC component whose polarization direction is opposed to that of the DC component, amplitude A1 being greater than amplitude A2. The asymmetry means are provided with means for rendering the period of conduction of the first switching element S1 unequal to the period of conduction of the second switching element S2.

Figure 2:
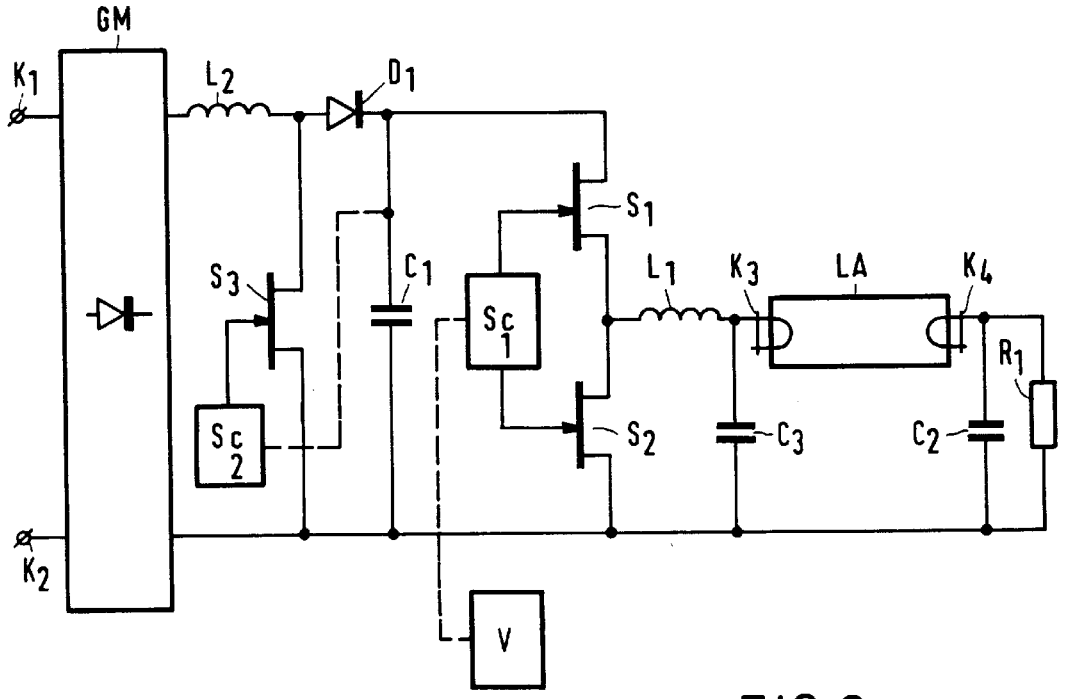
FIG. 2 is a diagram of a further embodiment of a circuit arrangement according to the invention.

In the embodiment shown in FIG. 2, all circuit portions and components corresponding to circuit portions and components of the embodiment shown in FIG. 1 have been given the same reference symbols. The embodiment of FIG. 2 comprises a DC-DC converter coupled between the outputs of the rectifying means GM and the capacitor C1 and provided with a switching element S3, a unidirectional element D1, an inductive element L2, and a circuit portion SC2. The circuit portion SC2 in this embodiment forms control means and is coupled to capacitor C1 and to the switching element S3. Inductive element L2 in this embodiment is a coil, and unidirectional element D1 is a diode. The first output of rectifying means GM is connected to a first side of capacitor C1 by means of a series arrangement of coil L2 and diode D1. Switching element S3 connects a common junction point of coil L2 and diode D1 to a second side of capacitor C1 and also to the second output of the rectifying means GM. An output of circuit portion S2 is connected to a control electrode of switching element S3. An input of circuit portion SC2 is coupled to capacitor C1. This coupling is indicated in FIG. 2 with a broken line. The remaining portion of the embodiment shown in FIG. 2 is constructed in the same way as the embodiment shown in FIG. 1.

The operation of the embodiment shown in FIG. 2 is as follows.

The operation of the portion of the embodiment shown in FIG. 2 corresponding to that shown in FIG. 1 is similar to the operation of the embodiment shown in FIG. 1. When the embodiment shown in FIG. 2 is operating, circuit portion SC2 generates a high-frequency signal with which the switching element S3 is rendered conducting and non-conducting at a high frequency. Capacitor C1 is charged thereby with high-frequency current pulses. The circuit portion SC2 adjusts the frequency and/or duty cycle of the high-frequency signal generated by it in dependence on the instantaneous value of the voltage across capacitor C1. It is thus achieved that the amplitude of the second low-frequency DC component of the voltage across capacitor C1 is comparatively small. As a result of this, the ratio between the average amplitude of the high-frequency AC component and the amplitude of the low-frequency modulation is comparatively high, which promotes the suppression of the striations. In this embodiment, the amplitude of the second, low-frequency DC component of the voltage across capacitor C1 is maintained at a comparatively low level without the necesity of choosing a comparatively high capacitance value for capacitor C1.

A practical realisation of the embodiment shown in FIG. 1 was used for operating a low-pressure mercury discharge lamp of the TLD type with a power rating of 58 W. The maximum lamp power set was approximately 50 W. The capacitance of capacitor C1 was 10 $\mu$F, the capacitance of capacitor C2 100 nF, and the capacitance of capacitor C3 was 5.6 nF. The resistance value of ohmic resistor R1 was 68 kΩ. The self-induction of the coil L1 was 1.35 mH. The amplitude of the DC component of the lamp current was approximately 3 mA. The asymmetry means present were not used, so that the conduction periods of the switching elements were approximately equal. The power consumed by the low-pressure mercury discharge lamp could be set through adjustment of the conduction periods of the switching elements. The frequency of the high-frequency AC component of the lamp current varied between 48 kHz and 90 kHz. It was achieved by means of this dimensioning that the average amplitude of the high-frequency lamp current component was approximately 500 times the amplitude of the low-frequency modulation of the high-frequency lamp current component during lamp operation with the power set for 50 W. The amplitude of the first DC component of the voltage across capacitor C1 was approximately 20 times the amplitude of the second, low-frequency DC component of the voltage across capacitor C1 (400 V versus 20 V) with the power set for its maximum adjustable value. It was found to be possible to adjust the luminous flux of the low-pressure mercury discharge lamp to a value of no more than one percent of the luminous flux accompanying an adjusted power consumption of 50 W without striations being visible in the low-pressure mercury discharge lamp.

We claim:

1. A circuit arrangement for operating a discharge lamp comprising:

input terminals for connection to a low frequency supply voltage source having a frequency f, rectifying means coupled to the input terminals for rectifying the low-frequency supply voltage delivered by the supply voltage source, capacitive means coupled to outputs of the rectifying means, a DC-AC converter coupled to the capacitive means for generating a lamp current which comprises a DC component and a high-frequency AC component, the amplitude of the high-frequency AC component being modulated with a low frequency which is equal to twice the frequency f, means for adjusting the power consumed by the discharge lamp, and wherein the dimensioning of the circuit arrangement is chosen such that the average amplitude of the high-frequency lamp current component is at least 500 times the amplitude of the low-frequency modulation of the high-frequency lamp current component during lamp operation and with the lamp power set for a maximum value.

2. A circuit arrangement as claimed in claim 1, wherein a load branch is coupled to the DC/AC converter and comprises a series circuit of terminals for accommodating the discharge lamp and a capacitive element, the capacitive element being shunted by an ohmic resistor.

3. A circuit arrangement as claimed in claim 1, further comprising a DC-DC converter for suppressing striations and coupled between the output of the rectifying means and the capacitive means and provided with a switching element, a unidirectional element, an inductive element, and control means coupled to the capacitive means and to the switching element to control the frequency and/or duty cycle of the switching element so as to suppress striations in the discharge lamp.

4. A circuit arrangement as claimed in claim 1, wherein a voltage is present across the capacitive means during lamp operation which is the sum of a first DC component of substantially constant amplitude and a second, low-frequency DC component having a frequency equal to twice the frequency f, and wherein the capacitance of the capacitive means is chosen such that the amplitude of the first DC component is at least 20 times the amplitude of the second, low-frequency DC component with the power set for said maximum value.

5. A circuit arrangement as claimed in claim 1 further comprising asymmetry means for making an amplitude A1 of the high-frequency AC component of the lamp current in the polarization direction of the DC component of the lamp current unequal to an amplitude A2 of the high-frequency AC component of which the polarization direction is opposed to that of the DC component.

6. A circuit arrangement as claimed in claim 5, wherein the amplitude A1 is greater than the amplitude A2.

7. A circuit arrangement as claimed in claim 5, wherein the DC-AC converter comprises a branch comprising a series arrangement of a first switching element and a second switching element, a load branch shunting one of the switching elements and provided with terminals for accommodating the discharge lamp, a control circuit coupled to the switching elements for rendering said switching elements alternately conducting and non-conducting at a high frequency, and wherein the asymmetry means include means for making the period of conduction of the first switching element unequal to the period of conduction of the second switching element.

8. A circuit arrangement as claimed in claim 1 further comprising a load circuit coupled to an output of the DC-AC converter and comprising:

an inductor, the discharge lamp and a first capacitor connected in series circuit, a second capacitor connected to a junction point between the inductor and the discharge lamp, and a resistor connected in parallel with the first capacitor.

9. A circuit arrangement as claimed in claim 1 further comprising means controlled by a voltage on said capacitive means for supplying high frequency unidirectional current pulses to the capacitive means.

10. A circuit arrangement as claimed in claim 9 wherein said means for supplying comprises;

an inductor and a diode connected in series circuit between an output of the rectifying means and the capacitive means, a semiconductor controlled switch coupled to a junction point between the inductor and the diode, and a high frequency drive circuit coupled to a control electrode of the semiconductor switch and to the capacitive means thereby to control the frequency and/or duty cycle of the semiconductor switch as a function of the voltage on the capacitive means.

11. A circuit arrangement as claimed in claim 2 wherein a voltage is produced across the capacitive means during lamp operation which is the sum of a first DC component of substantially constant amplitude and a second low-frequency DC component having a frequency equal to twice the frequency f and which determines the low frequency modulation of the high frequency component of lamp current, and the circuit arrangement dimensioning is adjusted by at least one of the following parameters, the capacitance of the capacitive means and the capacitance of the capacitive element.

12. A circuit arrangement as claimed in claim 11 further comprising means controlled by a voltage on said capacitive means for supplying high frequency unidirectional current pulses to the capacitive means, and the circuit arrangement dimensioning is adjusted by at least one of the parameters in claim 11 and the frequency and/or duty cycle of the means for supplying high frequency unidirectional current pulses to the capacitive means.

13. A circuit for operating a discharge lamp comprising:

input terminals for connection to a low frequency supply voltage source having a frequency f, rectifying means coupled to the input terminals for rectifying the low-frequency supply voltage, capacitive means coupled to outputs of the rectifying means, a load circuit for connection to the discharge lamp, means coupled to the capacitive means and to the load circuit for generating a lamp current which comprises a DC component and an amplitude modulated high-frequency AC component with the amplitude of the high frequency AC component modulated at a low frequency, means for adjusting the power consumed by the discharge lamp, and wherein the circuit components are chosen such that the ratio of the average amplitude of the high frequency lamp current component to the amplitude of the low frequency modulation of the high frequency lamp current component during lamp operation is 500 to 1 with the power set for a maximum adjustable rated value.

14. The circuit as claimed in claim 13, wherein said means for generating a lamp current comprises switching means for generating a square wave voltage having a duty cycle, and further comprising asymmetry means for making the duty cycle unequal to 50%.

15. The circuit as claimed in claim 13 wherein the load circuit comprises a series circuit of a capacitive element and lamp connection terminals and a resistor in parallel with the capacitive element, whereby striations in said discharge lamp are suppressed even when the power adjusting means adjusts lamp power to a very low value.

16. The circuit as claimed in claim 13 wherein said means for generating a lamp current comprises first and second switching elements connected in series circuit across the capacitive means, and the load circuit comprises an inductor connected in series circuit with a capacitive element and the lamp connection terminals, and a resistor in parallel with the capacitive element, the load circuit being connected in parallel with one of said switching elements.

17. The circuit as claimed in claim 13 further comprising means controlled by a voltage on said capacitive means for supplying high frequency unidirectional current pulses to the capacitive means.

18. The circuit as claimed in claim 13, wherein said means for generating a lamp current comprises switching means for generating a square wave voltage, and said power adjusting means comprises means for adjusting the frequency and/or duty cycle of said switching means.

19. The circuit as claimed in claim 13 wherein a voltage is produced across the capacitive means during lamp operation which is the sum of a first DC component of substantially constant amplitude and a second low frequency DC component having a frequency equal to twice the frequency f and which determines the low frequency modulation of the high frequency component of lamp current, and the capacitance of the capacitive means is chosen such that the amplitude of the first DC component is at least 20 times the amplitude of the second low frequency DC component with the power set for its maximum adjustable value.

20. The circuit as claimed in claim 17 wherein the load circuit further comprises a capacitive element connected in series with terminals adapted for connection to the discharge lamp, and to reduce striations the circuit arrangement dimensioning is adjusted by at least one of the following parameters, the capacitance of the capacitive means, the capacitance of the capacitive element, and the frequency and/or duty cycle of the means for supplying high frequency unidirectional current pulses to the capacitive means.

21. The circuit as claimed in claim 13 further comprising means for supplying high frequency unidirectional current pulses to the capacitive means and the frequency and/or duty cycle of the means for supplying high frequency unidirectional current pulses is chosen so as to aid in reducing striations in the discharge lamp.

* * * * *